US006546218B2

(12) United States Patent
Uchida

(10) Patent No.: US 6,546,218 B2
(45) Date of Patent: Apr. 8, 2003

(54) IMAGE FORMING APPARATUS

(75) Inventor: Michio Uchida, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/816,452

(22) Filed: Mar. 26, 2001

(65) Prior Publication Data

US 2001/0046393 A1 Nov. 29, 2001

(30) Foreign Application Priority Data

Mar. 31, 2000 (JP) ..... 2000-099586

(51) Int. Cl.[7] ..... G03G 15/00; G03G 15/08
(52) U.S. Cl. ..... 399/167; 399/228
(58) Field of Search ..... 399/298, 299, 399/303, 306, 312, 313, 228

(56) References Cited

U.S. PATENT DOCUMENTS 5,068,691 A * 11/1991 Nishio et al. ..... 399/284
5,765,082 A * 6/1998 Numazu et al. ..... 399/299
6,192,207 B1 * 2/2001 Yamamoto et al. ..... 399/82
6,324,374 B1 * 11/2001 Sasamoto et al. ..... 399/298
6,334,039 B1 * 12/2001 Yoshinaga et al. ..... 399/298
2001/0031152 A1 * 10/2001 Kaneko et al. ..... 399/107

* cited by examiner

*Primary Examiner*—Quana M. Grainger
(74) *Attorney, Agent, or Firm*—Fitzpatrick, Cella, Harper & Scinto

(57) ABSTRACT

An image forming apparatus including a plurality of process stations vertically arranged each of which includes an image bearing member on which a latent image is to be formed and a developing device for developing the latent image, image bearing member driving devices, for driving the image bearing members, development driving devices, for driving the developing devices, and a transfer material bearing and conveying device for bearing and conveying the transfer material, wherein, while the transfer member is vertically conveyed through transfer nips that are formed by the transfer material bearing and conveying device and the image bearing members of all of the plurality of process stations, images formed by the plurality of pocess stations are sequentially transferred to the transfer material to form an image, and wherein process stations to be used for image forming can be selected, and the image bearing member driving devices and the development driving devices are controlled, so that, during an image forming process, the image bearing members of the process stations that are not used for image forming are driven, while the developing devices thereof are halted.

18 Claims, 13 Drawing Sheets

IMAGE FORMING APPARATUS

BACKGROUND OF THE INVENTION

1. Field of the Invention

The present invention relates to an image forming apparatus, such as a printer or a copier, of an electrophotographic system or an electrostatic recording system, and relates in particular to a color image forming apparatus wherein a plurality of image forming means are arranged vertically.

2. Related Background Art

Recently, speed, function and color recording has been developed for image forming apparatuses of an electrophotographic system, and various types of printers and copiers are available on the market.

Above all, image forming apparatuses of an in-line system, in which image forming means for plural colors are disposed in series and toner images are sequentially multi-layer transferred, can form color images at high speed, and it is anticipated that in the future color printers incorporating such in-line type image forming apparatuses will be the primary color printers.

An in-line type image forming apparatus employs a method whereby a recording medium (transfer material) is borne on the surface of belt-shaped conveying means, for transporting the recording medium, while toner images are sequentially transferred to the recording medium to form a multi-layer color image. According to this method, the configurations of the apparatuses can be roughly sorted into two types, depending on the direction in which the recording media are conveyed.

In one configuration, as is shown in FIG. 9, process stations 8M, 8C, 8Y and 8K, which are first, second, third and fourth image forming means for different colors, are arranged substantially horizontally along a transferring and conveying belt 7 as an endless conveying means for conveying a recording medium, and a recording medium 1 is borne on and conveyed horizontally by the transferring and conveying belt 7 while an image is formed. In another configuration, as shown in FIG. 10, the first to fourth process stations 8M, 8C, 8Y and 8K are arranged vertically (substantially in the gravitational direction) along the transferring and conveying belt 7, so that a recording medium 1 is conveyed vertically while an image is formed.

For the thus constructed color image forming apparatuses to output full color images, as shown in FIGS. 9 and 10 the four color process stations 8M, 8C, 8Y and 8K, or more specifically, photosensitive drums 9M, 9C, 9Y and 9K, which are image bearing members, are brought into close contact with the conveying belt 7. Then, to form an image, a recording medium 1 is attracted by an attracting roller 18 to the surface of the transferring and conveying belt 7 so that the recording medium 1 is conveyed. Finally, to obtain a full color image, the respective color toner images are sequentially transferred to the recording medium 1.

On the contrary, when, for example, only a black image is to be formed by using only the fourth process station 8K, which is located downstream-most in the direction in which the transferring and conveying belt 7 moves, the first to the third, upstream process stations 8M, 8C and 8Y are not required, i.e., are not used for an image formation. As shown in FIGS. 11 and 12, the first to the third process stations 8M, 8C, and 8Y are halted and a separation roller 19 separates the transferring and conveying belt 7 from the first to the third process station. With this arrangement, since developing devices 12M, 12C and 12Y, of the first to the third process stations 8M, 8C and 8Y perform no unnecessary operations, the service lives of these components can be extended.

However, in the arrangement shown in FIG. 12, a recording medium 1 is conveyed substantially vertically (substantially in the gravitational direction). When only the black color image is developted, the recording medium 1 must arrive at the downstream-most, fourth process station 8K, while closely attracted to the transferring and conveying belt 7. Thus, a high voltage must be applied to the attracting roller 18 to attract the recording medium 1 to the transferring and conveying belt 7, and the cost for the power supply required by the attracting roller 18 is increased.

Further, when a recording medium 1 is rather damp or is bent, or when a recording medium 1 is formed with double sheets of paper such as an envelope, the force of attraction is deteriorated, so that the recording medium 1 tends to fall off due to its own weight to cause a paper jam.

In the above normal arrangement, the image forming procedures for which only black and for which full color is used can easily be distinguished, one from the other. However, this is not so for the case shown in FIG. 13, where the first and the third process stations 8M and 8Y output images, while the second and fourth process stations 8C and 8K do not output images. In this case, the second and the fourth process stations 8C and 8K which are not required to form images must be driven. Therefore, the developing devices 9C and 9K in the second and the fourth process stations 8C and 8K are ealy deteriorated.

SUMMARY OF THE INVENTION

It is an object of the present invention to provide an image forming apparatus that forms an image while conveying a transfer material vertically, and wherein the service life of developing means is extended.

It is another object of the present invention to provide an image forming apparatus that forms an image while conveying a transfer material vertically, and wherein the conveyance of a transfer material is ensured without an increase in cost.

To achiever the above objects, according to the present invention, an image forming apparatus comprises: a plurality of image forming means vertically arranged each of which includes an image bearing member on which a latent image is to be formed and developing means for developing the latent image; image bearing member driving means for driving the image bearing members, respectively; development driving means for driving the developing means, respectively; transfer material bearing and conveying means for bearing and conveying the transfer material; and control means for selecting image forming means to be used for image forming from among the plurality of image forming means, and for controlling the image bearing member driving means and the development driving means, so that, during an image forming process, image bearing members of image forming means that are not used for image forming among the plurality of image forming means are driven, while developing means of the image forming means that are not used for image forming are halted, wherein, while the transfer material is vertically conveyed through transfer nips that are formed by the transfer material bearing and conveying means and all the image bearing members of the plurality of image forming means, images formed by the plurality of image forming means are sequentially transferred to the transfer material to form an image.

With this arrangement, when the developing means is not being used for image forming, the developing means is halted so that unnecessary deterioration of the developing means can be prevented, thereby ensuring that the service life of the developing means is extended.

Further, since the image bearing member that is not being used for image forming can be driven and a transfer material can be conveyed while sandwiched between the transfer material bearing and conveying means and the image bearing members, the conveyance of the transfer material is ensured without an increase in cost being required.

DESCRIPTION OF THE PREFERRED EMBODIMENTS

Figure 1:
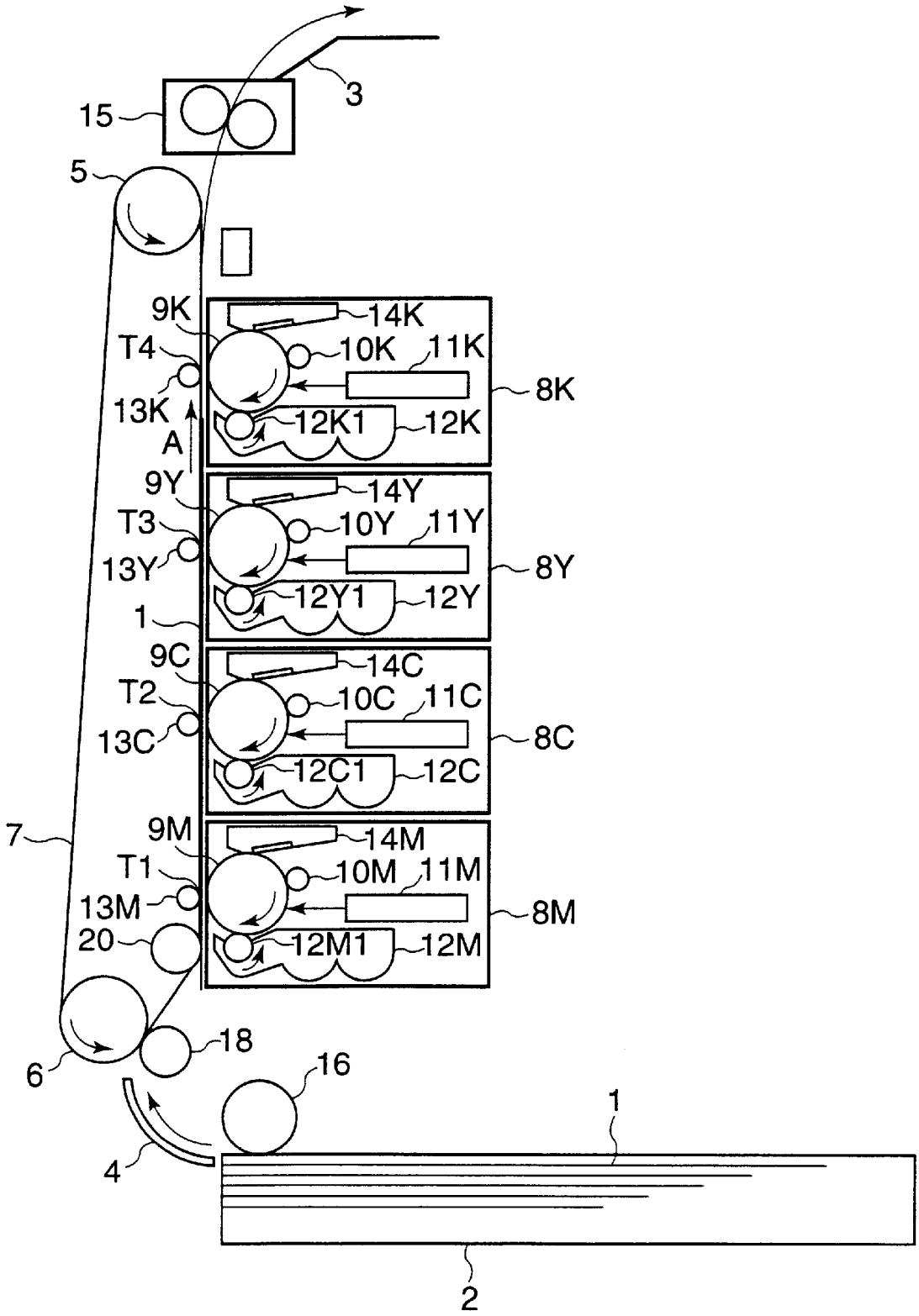
FIG. 1 is a diagram showing the configuration of an image forming apparatus according to an embodiment of the present invention.

An image forming apparatus according to the present invention will now be described in detail while referring to the accompanying drawings. The same reference numerals are used throughout to denote components that correspond to or are identical to the above described members.

(First Embodiment)

Figure 2:
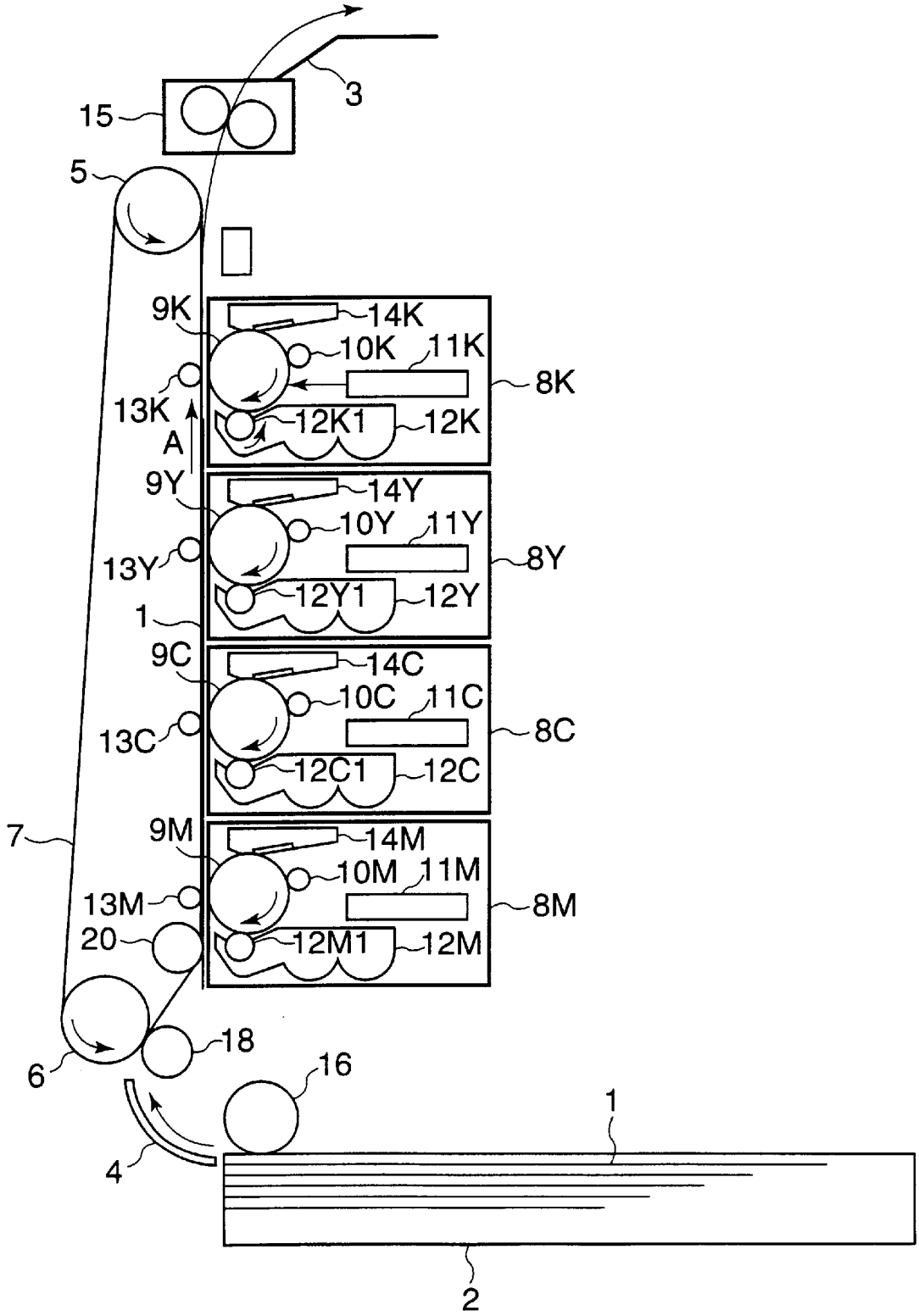
FIG. 2 is a diagram showing a state wherein only the fourth process station of the image forming apparatus in FIG. 1 is driven.
Figure 3:
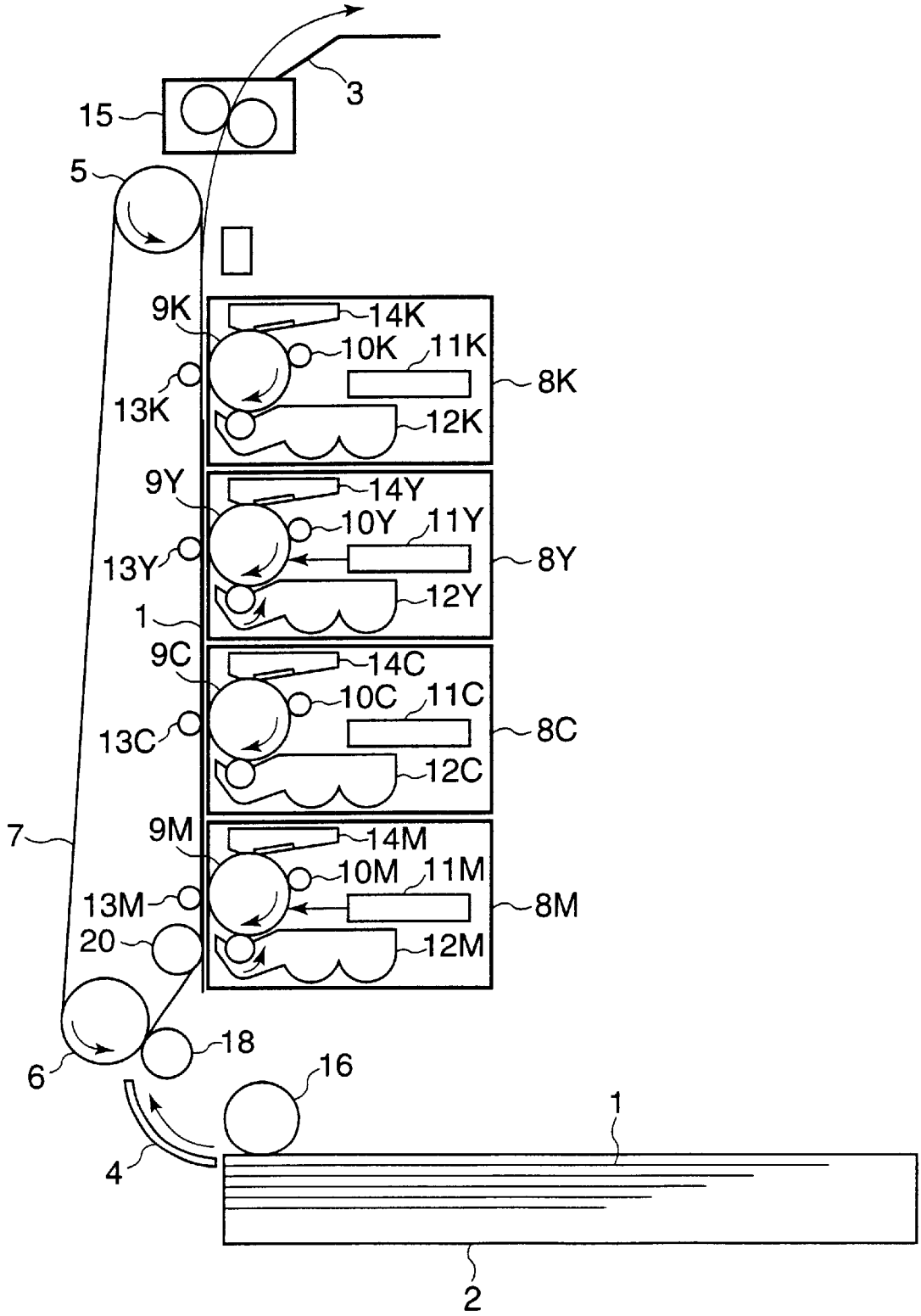
FIG. 3 is a diagram showing a state wherein the first and the third process stations of the image forming apparatus in FIG. 1 are driven.

A first embodiment of the invention will now be described while referring to FIGS. 1 to 3.

As is shown in FIG. 1, a full color image forming apparatus in this embodiment has a configuration in which process stations 8M, 8C, 8Y and 8K as the first, second, third and fourth image forming means are stacked substantially vertically (substantially in the gravitational direction). The process stations 8M to 8K respectively form magenta, cyan, yellow and black images.

The design that is used for all the process stations 8M to 8K is the same. The process stations 8M to 8K include photosensitive drums 9M, 9C, 9Y and 9K as image bearing members, chargers 10M, 10C, 10Y and 10K as charging means, developing devices 12M, 12C, 12Y and 12K as developing means containing developers (toners) of respective colors, cleaners 14M, 14C, 14Y and 14K, and exposing devices 11M, 11C, 11Y and 11K, respectively.

The developing devices 12M, 12C, 12Y and 12K employ a non-contact developing method, and development sleeves 12M1, 12C1, 12Y1 and 12K1, which are developer bearing members of the developing devices 12M to 12K, are separated by a gap of about 300 $\mu$m from their opposite photosensitive drums 9M to 9K. During developing, a development bias obtained by superimposing a rectangular alternate-current voltage on a direct-current voltage is applied to between the photosensitive drums 9M to 9K and the development sleeves 12M1 to 12K1.

Further, a transferring and conveying belt 7, which serves as transfer material bearing and conveying means for bearing and conveying a transfer material 1, is extended along the process stations 8M to 8K and around a drive roller 5, a driven roller 6 and a belt tensioning roller 20, which serve as belt drive means, and is moved in the direction indicated by an arrow A.

Full color image forming process will now be explained while referring to FIG. 1.

In the first process station 8M, after the photosensitive drum 9M has been uniformly charged by the charger 10M, a laser beam corresponding to magenta image information, is emitted to form an electrostatic latent image on the drum 9M. Then, to develop the electrostatic latent image, magenta toner, supplied by the developing device 12M, is transferred by the application of the development bias, and a magenta toner image is formed on the photosensitive drum 9M.

Recording sheets 1 as the transfer material are picked up one by one from a paper feed portion 2 by a pickup roller 16, and are fed along a paper feeding path 4 to the transferring and conveying belt 7. Then, the recording sheet 1 is attracted to and borne on the transferring and conveying belt 7 by an attracting roller 18 as the attracting means. Thence, in registry with the magenta toner image on the photosensitive drum 9M, the recording sheet 1 is conveyed to a transfer position T where the magenta toner image is transferred onto the recording sheet 1 by a transfer device 13M.

At the second, third and fourth process stations 8C, 8Y and 8K, in the same manner as the process performed at the first process station 8M, a cyan toner image, a yellow toner image and a black toner image are formed on the respective photosensitive drums 9C, 9Y and 9K, and as the recording sheet 1 is conveyed by the transferring and conveying belt 7 to transfer positions T2, T3 and T4 of the second, third and fourth process stations 8C, 8Y and 8K, transfer devices 13C, 13Y and 13K transfer and superimpose the respective color toner images on the recording sheet 1.

The recording sheet 1 onto which the four color toner images are transferred is conveyed from the fourth, downstream-most process station 8K to a fixing device 15. The fixing device 15 fixes the toner images to the recording sheet 1 and discharges the recording sheet 1 to a discharge portion 3.

The cleaners 14M to 14K remove residual toners from the photosensitive drums 9M to 9K, from which the images have been transferred, to prepare the photosensitive drums 9M to 9K for the next image forming sequence.

An explanation will now be given, while referring to FIG. 2, for the image output process, i.e., the image forming process, wherein only the fourth, downstream-most process station 8K is used.

During the image output process for which only the fourth, downstream-most process station 8K is used, the developing devices 12M, 12C and 12Y of the first, second and third, upstream process stations 8M, 8C and 8Y, are halted. Since the developing devices 12M to 12K of this embodiment employ the non-contact developing method described above, the development sleeves 12M1 to 12K1 are not rubbed with the photosensitive drums 9M to 9K, regardless of whether an image is being output or not.

At this time, the photosensitive drums 9M to 9Y of the first to third process stations 8M to 8Y, which are not being used for image output, are driven in contact with the transferring and conveying belt 7, and serve as feeding rollers to advance the recording sheet 1 to the fourth process station 8K, which is being used for the image output.

The image output process using the first and third process stations 8M and 8Y will now be described while referring to FIG. 3.

During this process, the developing devices 12C and 12K of the second and fourth process stations 8C and 8K, which are not being used for image output, are halted.

Furthermore, the photosensitive drums 9C and 9K of the second and fourth process stations 8C and 8K, which are not being used for image output, closely contact the transferring and conveying belt 7, and serve as feed rollers for conveying the recording sheet 1.

As is described above, according to the embodiment, as the developing device that are not used for image output are halted, unnecessary deterioration of the developing devices can be prevented, and their service lives can be extended. Further, since the photosensitive drums that are not being used for image output serve as feed rollers for the recording sheet, even a damp or bent recording sheet, or one, such as an envelope, that is formed of folded paper, can be precisely conveyed, with no increase in apparatus cost, and defects, such as paper jamming, resulting from falling recording sheets can be prevented.

In this embodiment, the non-contact developing method, whereby a gap is maintained between a development sleeve and a photosensitive drum, has been employed. However, the contact developing method, whereby a development sleeve and a photosensitive drum contact each other, may also be employed and the same effects obtained.

(Second Embodiment)

A second embodiment of this invention will now be described while referring to FIGS. 4 to 7. A full color image forming apparatus in the second embodiment has substantially the same configuration as in the first embodiment, except that development sleeves 12K1 to 12M1 of developing devices 12M to 12K of first to fourth process stations 8M to 8K can be brought into contact with and be separated from opposite photosensitive drums 9M to 9K.

Figure 4:
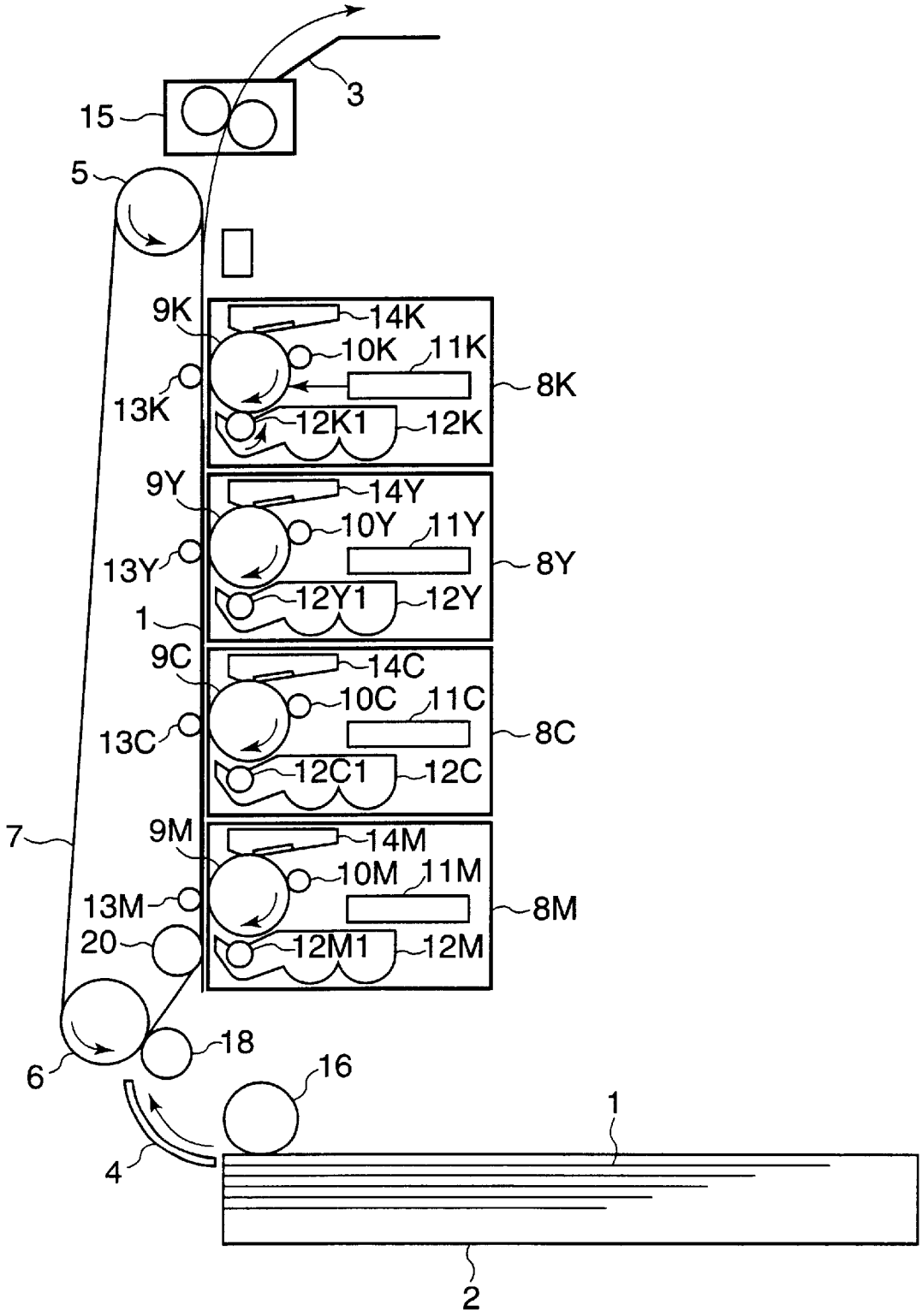
FIG. 4 is a diagram showing the configuration of an image forming apparatus according to another embodiment of the invention.

An image output process using only the fourth, downstream-most process station 8K will now be described while referring to FIG. 4.

During the image output process for which only the fourth, downstream-most process station 8K is used, the developing devices 12M, 12C 12Y, or more specifically, development sleeves 12M1, 12C1 and 12Y1, of the first, second and third, upstream process stations 8M, 8C and 8Y, are separated from the corresponding photosensitive drums 9M, 9C and 9Y and halted.

The photosensitive drums 9M to 9Y of the first to third process stations 8M to 8Y, which are not being used for image forming, are driven in close contact with the transferring and conveying belt 7, and serve as feed rollers for advancing a recording sheet 1 to the fourth process station 8K, which is being used for image output.

Figure 5:
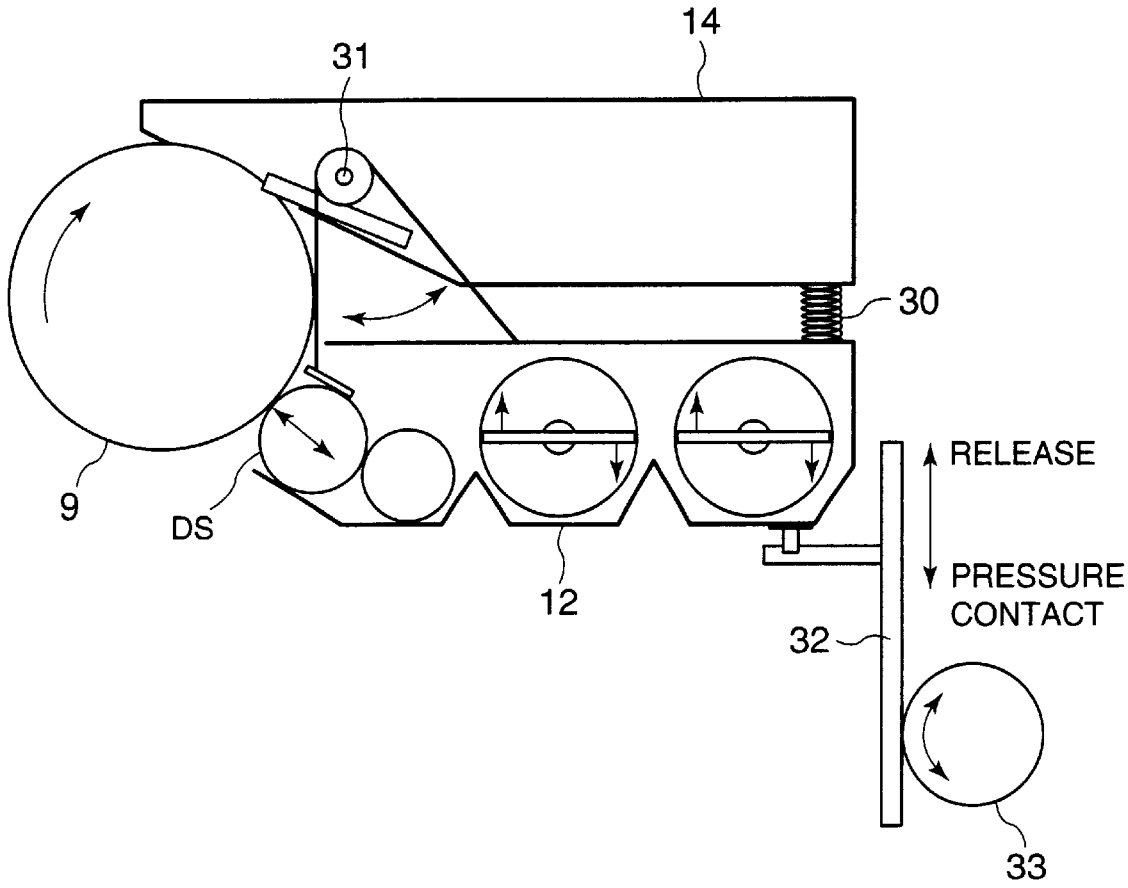
FIG. 5 is a diagram showing a development sleeve separating mechanism.

FIG. 5 is a diagram showing a contact-separation mechanism for a development sleeve DS in a process station. In FIG. 5, the developing device 12 is mounted to be rotatable about a fulcrum 31. With this arrangement, the development sleeve DS is contactable to and separable from the photosensitive drum 9. A spring 30 as urging means that is located between the cleaner 14 and the developing device 12 applies an urging force by which the developing device 12 is urget to be in contact with the photosensitive drum 9. As a developing device contact-separation motor 33 is driven, a developing device contact-separation lever 32 impelled by the contact-separation motor 33 pushes the bottom of the developing device 12 against the urging force of the spring 30 to rotate the developing device 12 about the fulcrum 31 and to separate the development sleeve DS from the photosensitive drum 9. Conversely, when the developing device contact-separation motor 33 is rotated in reverse, the developing device contact-separation lever 32 is lowered, and as a result, the development sleeve DS approaches the photosensitive drum 9.

Figure 6:
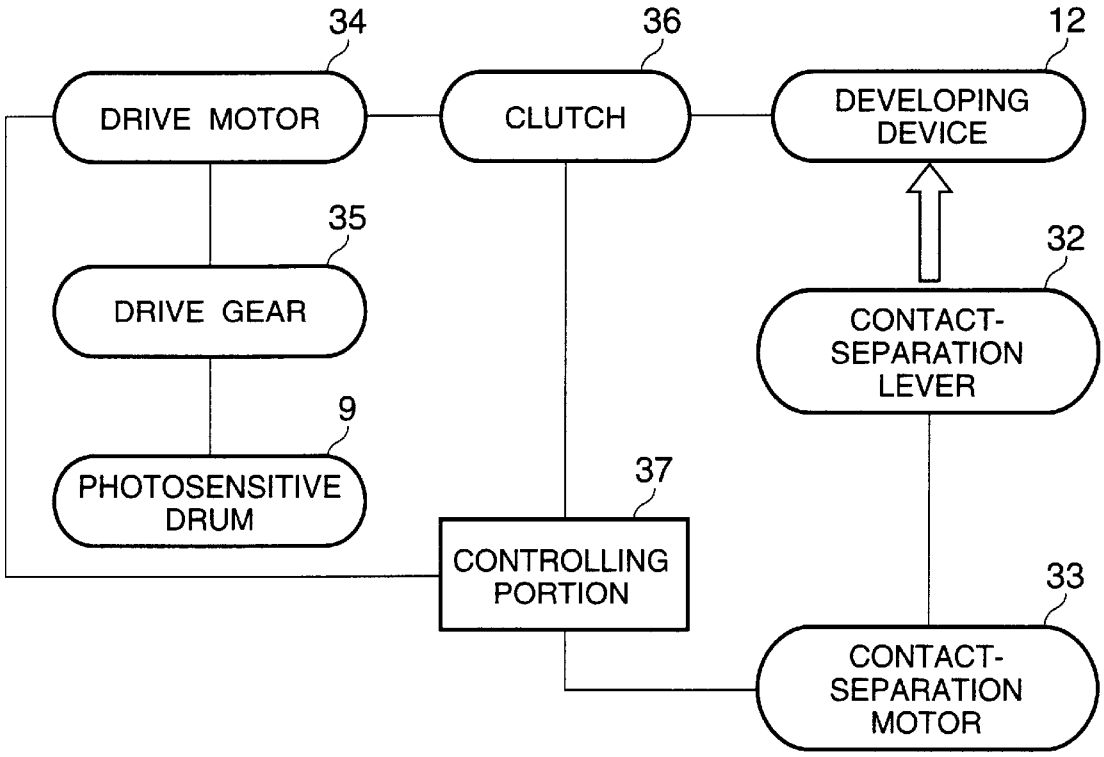
FIG. 6 is a block diagram showing a driving system.

FIG. 6 is a block diagram showing a driving unit of the second embodiment. A drive motor 34 is drive means for driving the photosensitive drum 9 and the developing device 12. The photosensitive drum 9 is driven via a drive gear 35, and the developing device 12 is driven by a clutch 36, which enables the release of the drive transmission to the developing device 12. The developing device 12 is separated from and brought into contact with the photosensitive drum 9, via the contact-separation lever 32, by the contact-separation motor 33. The drive motor 34, the clutch 36 and the contact-separation motor 33 are controlled by a controlling portion 37 as the control means.

In FIG. 6, the portion that includes the controlling portion 37, the clutch 36 and the drive motor 34 has the same structure as in the first embodiment.

Figure 7:
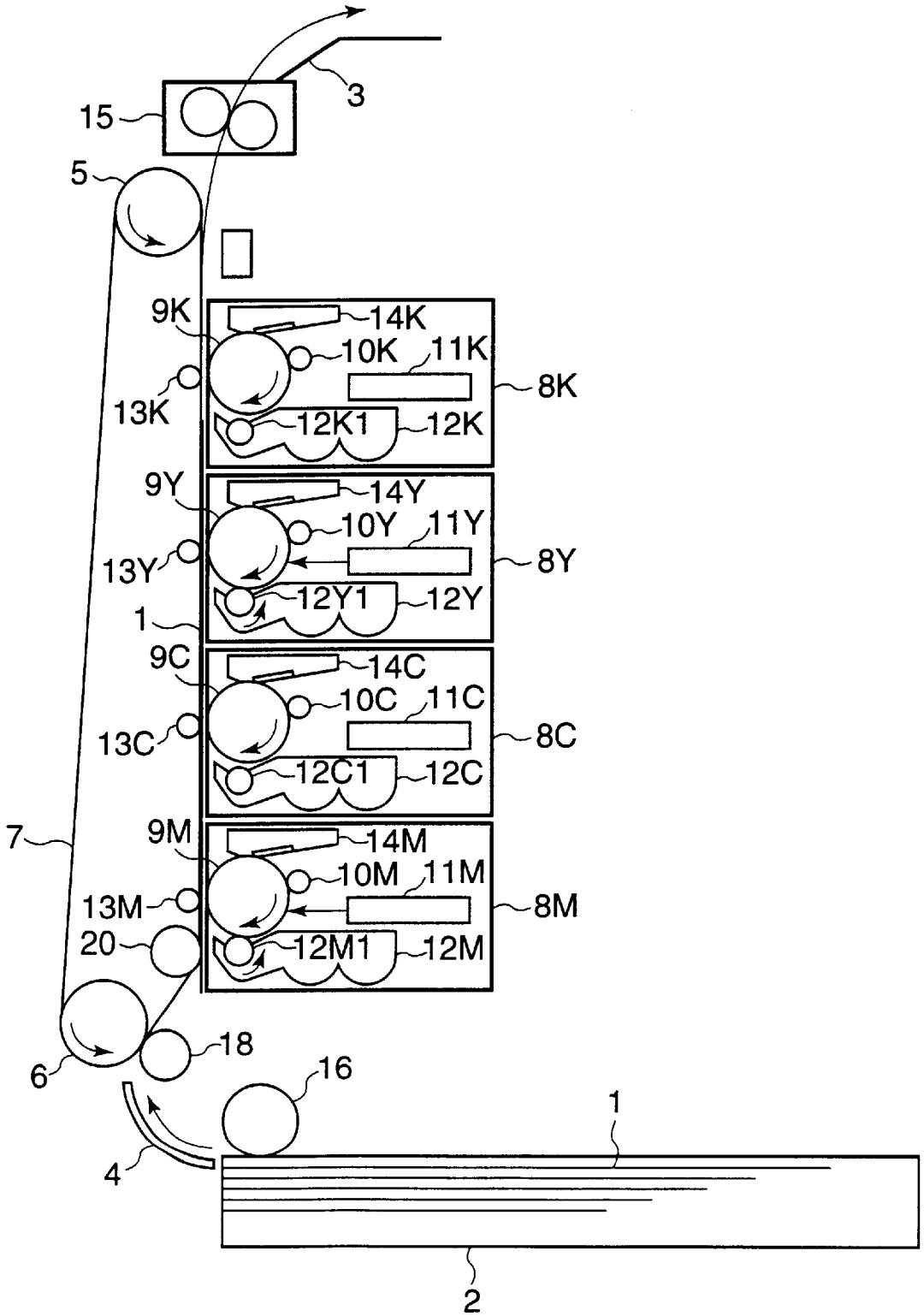
FIG. 7 is a diagram showing a state wherein the first and the third process stations of the image forming apparatus in FIG. 4 are driven.

An image output process for which only the first and third process stations 8M and 8Y are used will now be described while referring to FIG. 7.

In this case, the developing devices 12C and 12K, or more specifically, the development sleeves 12C1 and 12K1, of the second and fourth process stations 8C and 8K, which are not used for image output, are separated from their opposite photosensitive drums 9C and 9K and halted.

The photosensitive drums 9C and 9K of the second and fourth process stations, which are not used for image output, are driven in close contact with the transferring and conveying belt 7, and serve as feed rollers for conveying the recording sheet 1.

As is described above, according to the contact developing method in this embodiment, since the developing devices that are not used for image output are halted and separated from their opposite photosensitive drums, unwanted friction can be prevented between the photosensitive drums and the development sleeves, so that the service life of each of the developing devices can be extended. According to this embodiment, even if a developing device uses a non-contact developing method, its service life can also be extended.

Furthermore, since the photosensitive drums that are not used for the image output serve as feed rollers for the recording sheet, even a damp or bent recording sheet, or one, such as an envelope, that is formed of folded paper, can be precisely conveyed, with no increase in apparatus cost, and defects, such as paper jamming, resulting from falling recording sheets 1 can be prevented.

(Third Embodiment)

Figure 8:
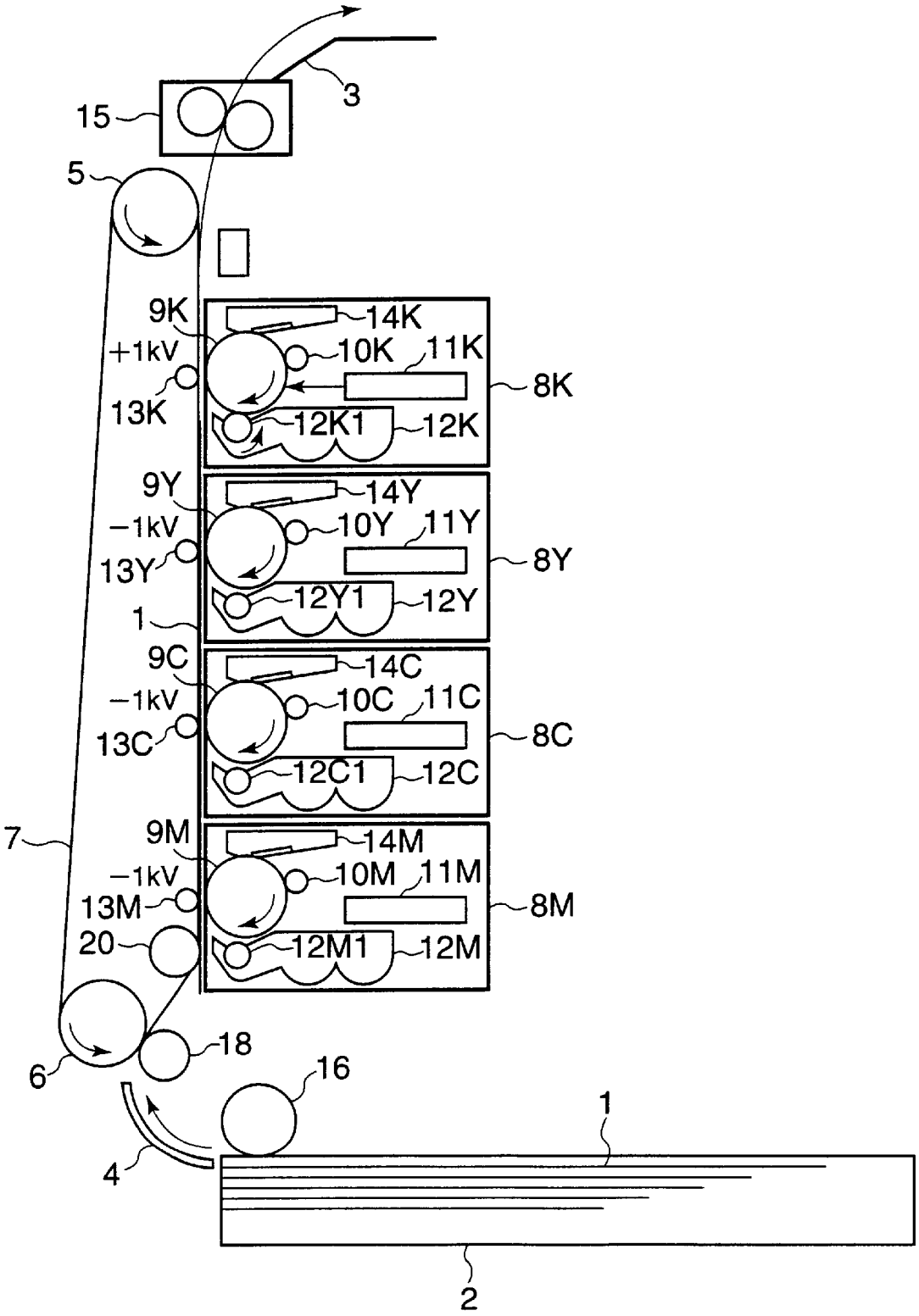
FIG. 8 is a diagram showing the configuration of an image forming apparatus according to still another embodiment of the invention.
Figure 9:
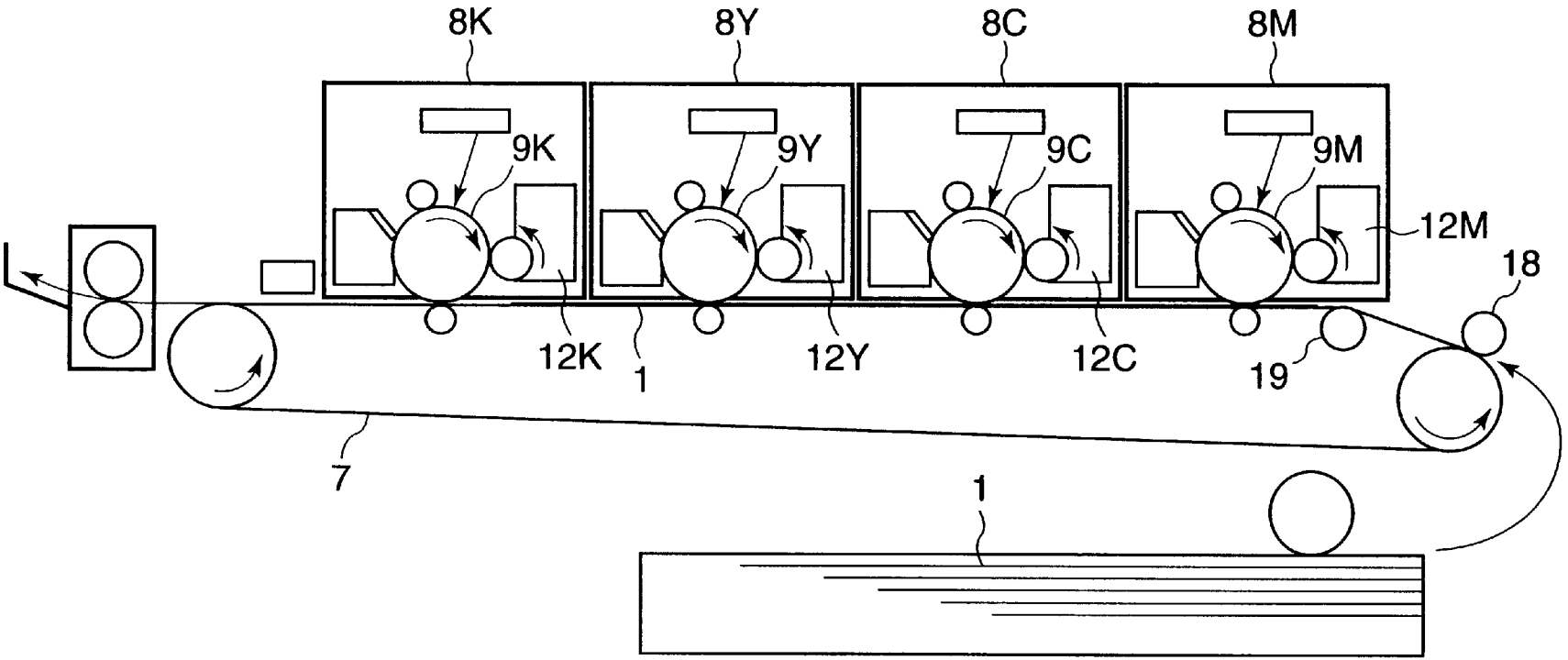
FIG. 9 is a schematic diagram showing an example arrangement of a conventional image forming apparatus.
Figure 10:
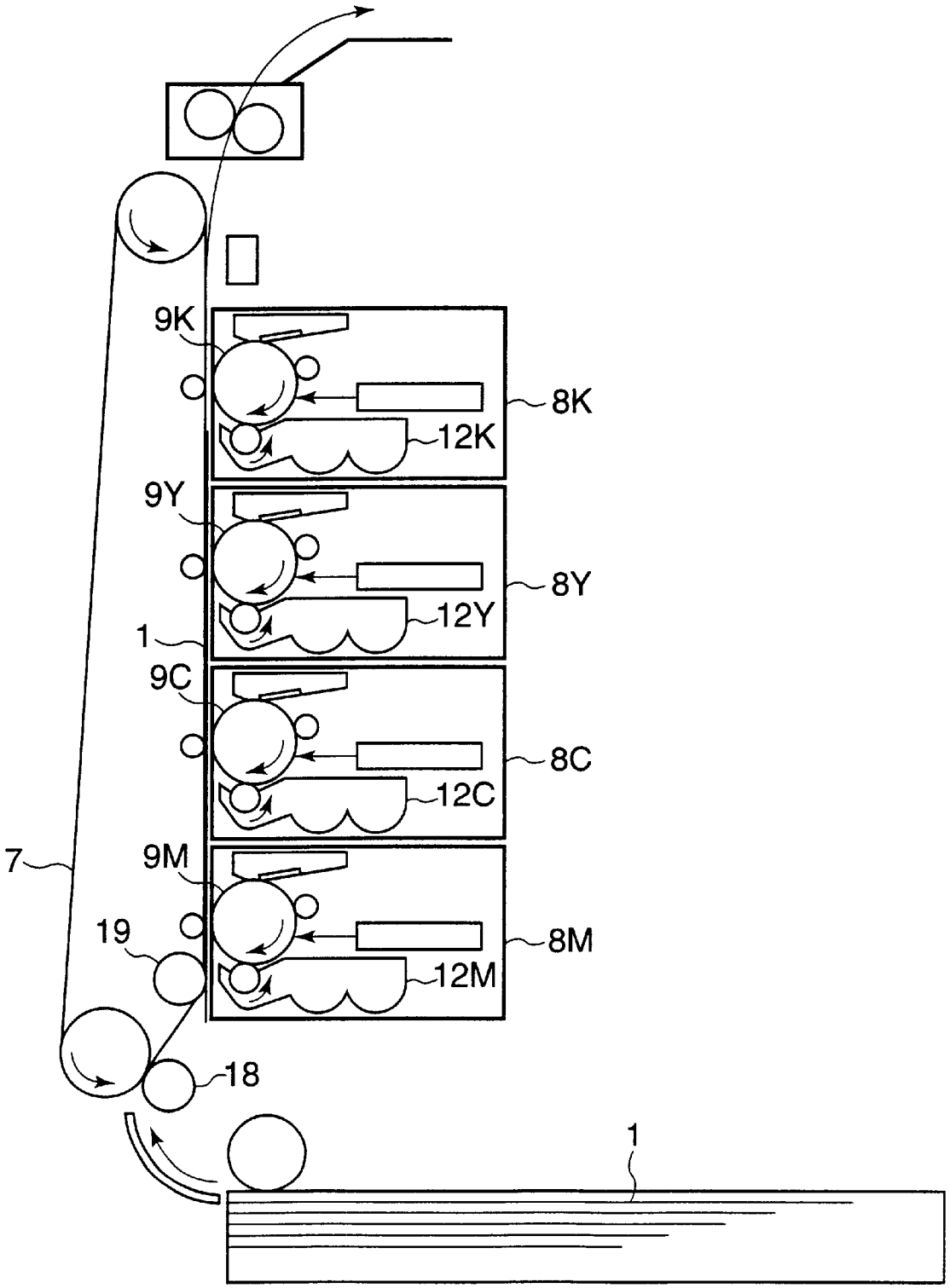
FIG. 10 is a schematic diagram showing another example arrangement of a conventional image forming apparatus.
Figure 11:
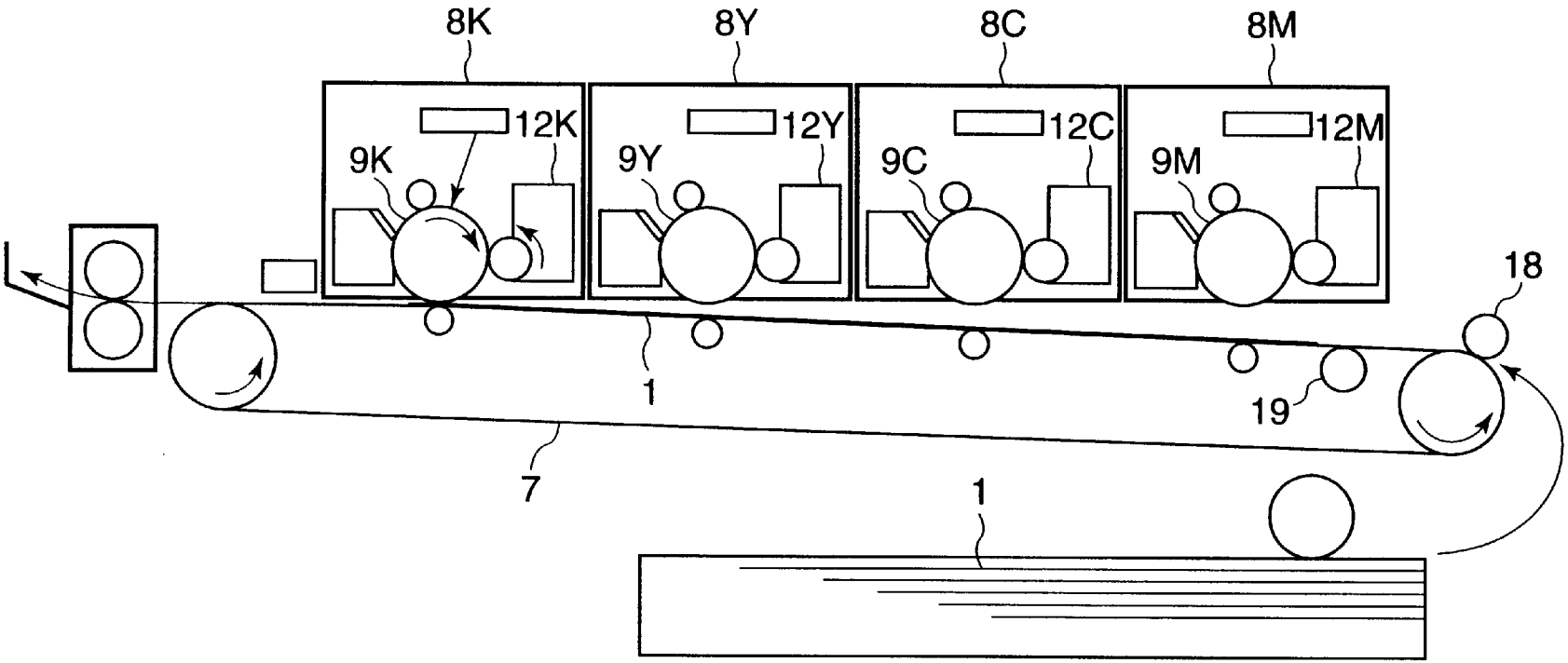
FIG. 11 is a diagram showing a state wherein only the fourth process station of the image forming apparatus in FIG. 9 is driven.
Figure 12:
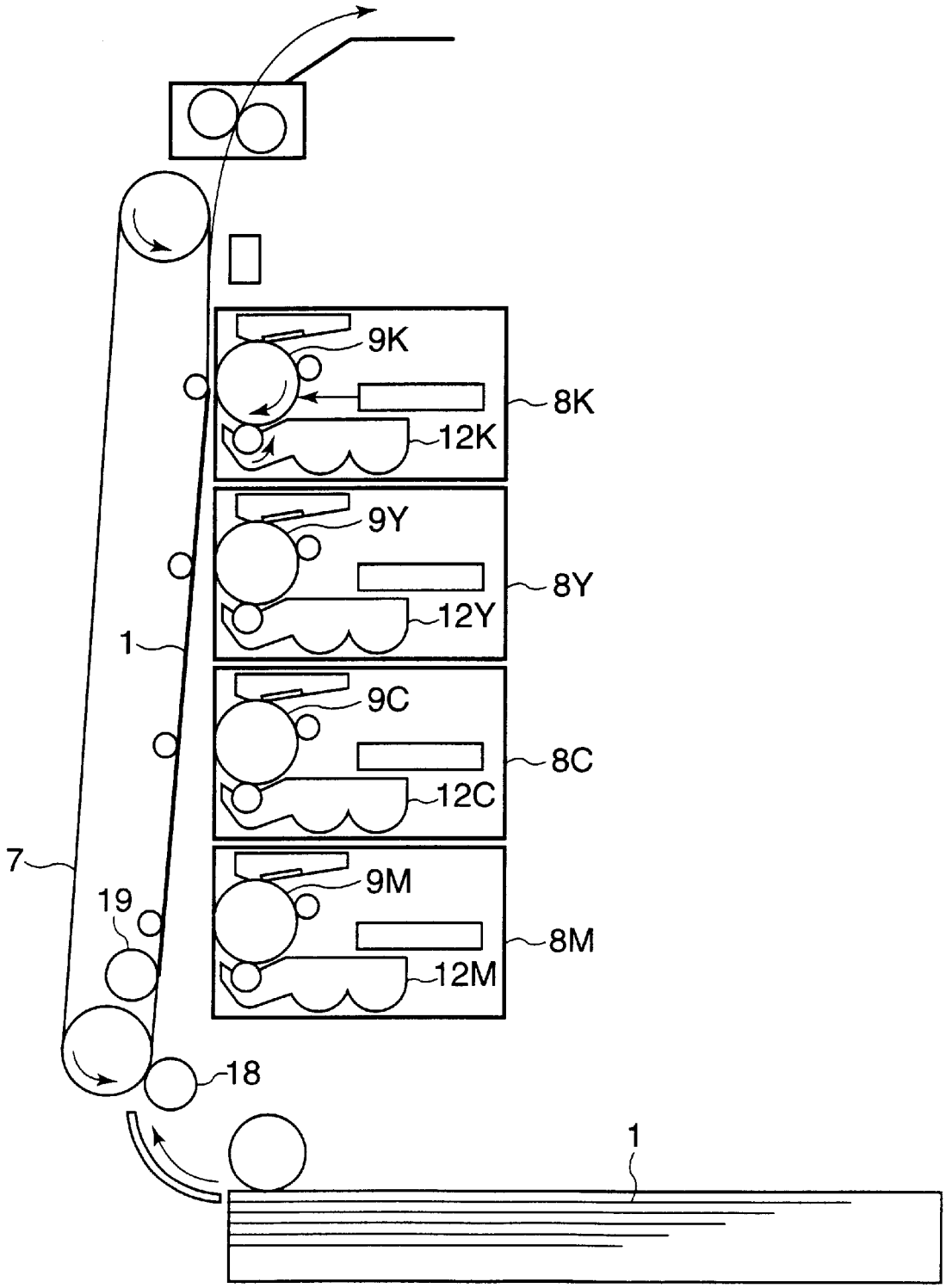
FIG. 12 is a diagram showing a state wherein only the fourth process station of the image forming apparatus in FIG. 10 is driven.
Figure 13:
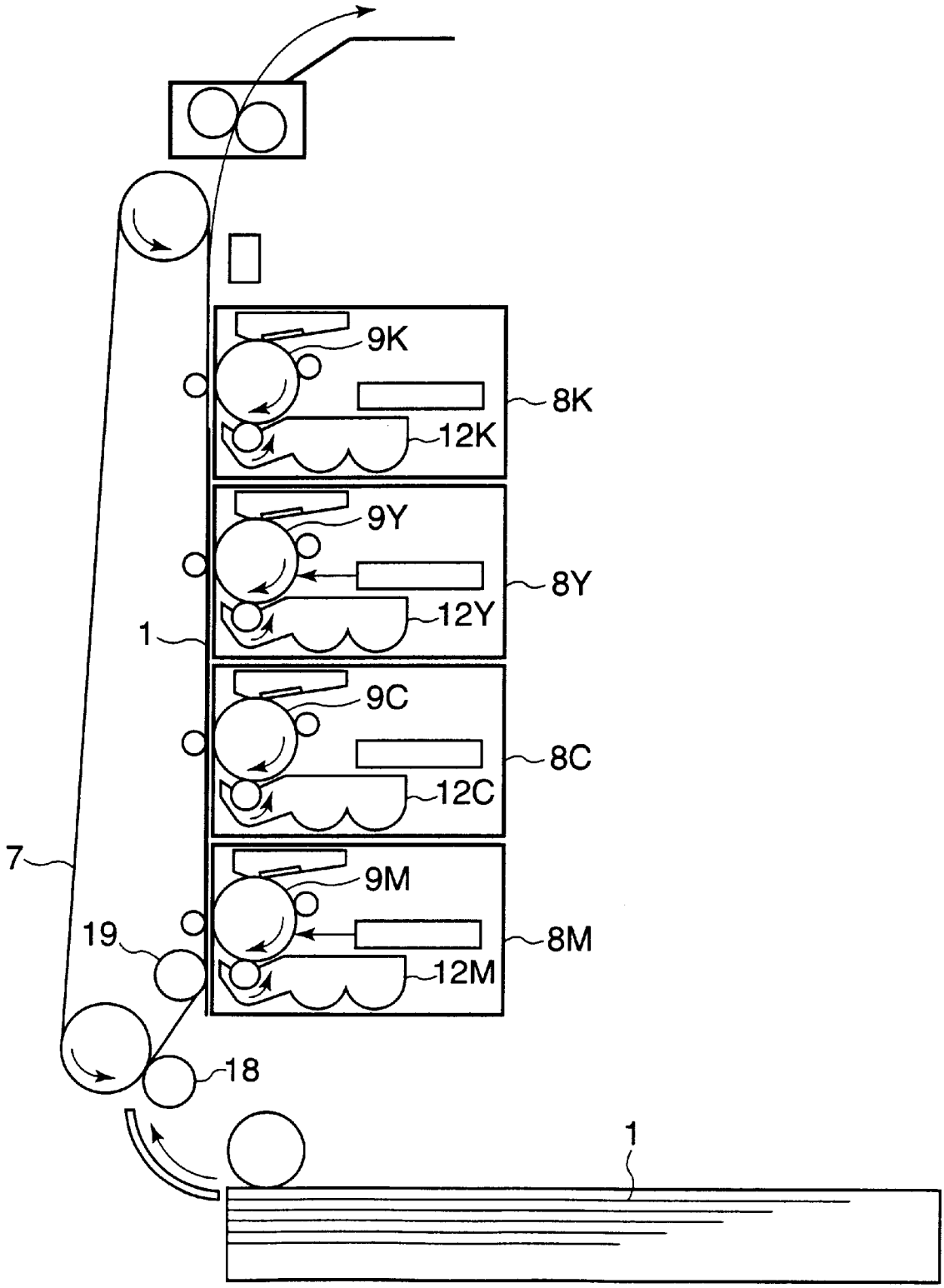
FIG. 13 is a diagram showing a state wherein the first and the third process stations of the image forming apparatus in FIG. 10 are driven.

A third embodiment of the invention will now be described while referring to FIG. 8. A full color image forming apparatus for this embodiment has basically the same configuration as in the second embodiment.

As is described above, in an image output process for which only the fourth, downstream-most process station 8K is used, developing devices 12M, 12C and 12Y, or more specifically, development sleeves 12M1, 12C1 and 12Y1 of the first to third, upstream process stations 8M, 8C and 8Y are separated from their opposite photosensitive drums 9M, 9C and 9Y and halted.

At this time, the photosensitive drums 9M to 9Y of the first to third process stations 8M to 8Y, which are not used for image output are driven and in contact with a transferring and conveying belt 7, and serve as feed rollers for conveying a recording sheet 1 to the fourth process station 8K, which is used for image forming.

At the same time, a conveying bias of, for example, −1 kV, which has a polarity that is the opposite of the polarity of the transfer bias applied during the transfer process, is applied to transfer devices 13M to 13Y of the first to third process stations 8M to 8Y that are not being used for image forming. As a result, the recording sheet 1 is strongly attracted to the transferring and conveying belt 7, and is more precisely conveyed.

Further, since a charge is applied that has a polarity opposite to the polarity of the charge applied during transfer process, the image transfer at the fourth process station 8K is easily performed. For example, since the transfer bias that generally requires 1.5 kV can be reduced to 1 kV, image failures can be prevented. So long as the conveying bias has no affect on an image, +1 kV may be employed as the conveying bias.

In this embodiment, the development sleeve of the developing device that is not used for image forming is separated from the photosensitive drum. However, the arrangement in the first embodiment may be employed instead of the arrangement in this embodiment.

As is described above, according to the embodiment, the recording sheet can be more accurately conveyed. Since the polarity of the conveying bias is taken into account, the transfer function can be improved, and a preferable image can be obtained.

(Fourth Embodiment)

A fourth embodiment will now be described. The feature of this embodiment is that only in the image forming process for which predetermined image forming means is used, developing means of the other image forming means that is not used for the image forming is halted. The arrangement of the second embodiment is employed for the other arrangement.

An explanation will now be given for a case wherein only the fourth, downstream-most process station 8K (black color) is designated as the predetermined image forming means, i.e., a case of the process for forming only a black image.

In the image output process using only the fourth, downstream-most process station 8K, developing devices 12M, 12C and 12Y, or more specifically, development sleeves 12M1, 12C1 and 12Y1 of the first, second and third process stations 8M, 8C and 8Y are separated form the corresponding photosensitive drums 9M, 9C and 9Y and halted.

The photosensitive drums 9M to 9Y of the first to third process stations 8M to 8Y, which are not used for image forming, are driven and in contact with a transferring and conveying belt 7, and serve as feed rollers for conveying a recording sheet 1 to the fourth process station 8K, which is used to output the image.

During the image forming process using other image forming means than the predetemined image forming means, in all the first to fourth process stations, all the photosensitive drums and all the developing devices are driven, and the development sleeves are not separated from the photosensitive drums. It should be noted that an image forming process using other image forming means than the predetermined image forming means is other color image forming process than the black image forming process, that uses any of the first to third process stations.

According to the present embodiment, only when a predetermined color (for example, black) image formation is frequently performed depending on a user's usage, the developing devices of any process stations which are not used for forming images can be halted and their development sleeves can be separated. Therefor, the control of the apparatus can be facilitated without any reductions in actual effectiveness.

In this embodiment, the image formation using only black has been explained. However, depending on the application required by a user, image forming means for another color may be designated as the predetermined image forming means.

Further, the arrangement for the second embodiment has been employed for this embodiment; however, the same effects can be obtained by using the arrangement of the first or third embodiment.

What is claimed is:

1. An image forming apparatus comprising:

a plurality of image forming means substantially vertically arranged, each of said plurality of image forming means including an image bearing member on which a latent image is to be formed and developing means for developing the latent image;

image bearing member driving means for driving said image bearing members;

development driving means for driving said developing means;

transfer material bearing and conveying means for bearing and conveying a transfer material, wherein, while the transfer material is upwardly conveyed in a substantially vertical direction through transfer nips that are formed by said transfer material bearing and conveying means and said image bearing members of said plurality of image forming means, images formed by said plurality of image forming means are sequentially transferred to the transfer material; and control means for selecting image forming means that is used for forming an image among said plurality of image forming means and for controlling said image bearing member driving means and said development driving means so that, during an image forming process, an image bearing member of image forming means that is not used for forming the image is driven and developing means of image forming means that is not used for forming the image is halted.

2. An image forming apparatus according to claim 1, wherein, during the image forming process, said control means controls said image bearing member drive means and said development driving means to drive an image bearing member and developing means, respectively, of image forming means that is used for forming the image.

3. An image forming apparatus according to claim 1, wherein each of said developing means includes a developer for developing the latent image and a developer bearing member disposed opposite to said image bearing member, said developer bearing member bearing the developer on a surface of said developer bearing member, and wherein separating means is provided for separating said image bearing member and said developer bearing member of image forming means that is not used for forming the image.

4. An image forming apparatus according to claim 3, wherein said developing means is retractable from said image bearing member, and said separating means retracts said developing means.

5. An image forming apparatus according to claim 4, wherein said developing means is rotatable about a fulcrum, and said separating means rotates said developing means about the fulcrum.

6. An image forming apparatus according to claim 3, further comprising urging means for urging said developing means toward said image bearing member.

7. An image forming apparatus according to claim 3, wherein said image bearing member and said developer bearing member are contactable with each other.

8. An image forming apparatus according to claim 1, wherein each of said developing means includes a developer for developing the latent image and a developer bearing member disposed opposite to said image bearing member, said developer bearing member bearing the developer on a surface of said developer bearing member, and wherein said developer bearing member and said image bearing member are maintained at a predetermined distance therebetween.

9. An image forming apparatus according to claim 1, further comprising:

a plurality of transfer means, disposed at positions opposite to each of said image bearing members with said transfer material bearing and conveying means therebetween, for transferring images on said image bearing members to the transfer material, wherein, during the image forming process, a voltage different from a voltage applied during a transfer process of the image forming process is applied to transfer means that corresponds to image forming means that is not used for forming the image.

10. An image forming apparatus according to claim 9, wherein the different voltage has a polarity opposite to a polarity of the voltage applied during the transfer process of the image forming process.

11. An image forming apparatus according to claim 1, further comprising:

a plurality of transfer means, disposed at positions opposite to each of said image bearing members with said transfer material bearing and conveying means therebetween, for transferring images on said image bearing members to the transfer material, wherein, during the image forming process, a charge having a polarity opposite to a polarity of a charge applied during a transfer process of the image forming process is applied to transfer means that corresponds to image forming means that is not used for forming the image.

12. An image forming apparatus according to any one of claims 1 to 11, wherein said transfer material bearing and conveying means has a belt member and belt driving means for driving said belt member.

13. An image forming apparatus according to claim 12, further comprising attracting means, disposed upstream of said plurality of image forming means in a transfer material conveying direction, for attracting the transfer material to said belt member.

14. An image forming apparatus according to claim 1, wherein only when a predetermined image forming means is selected for use, during an image forming process, image bearing members of image forming means that are not used for forming the image are driven and developing means of said image forming means that are not being used for forming the image are halted.

15. An image forming apparatus according to claim 14, wherein, when image forming means other than said predetermined image forming means is selected, said control means controls to drive said image bearing members and said developing means of all said plurality of image forming means.

16. An image forming apparatus according to claim 14, wherein said predetermined image forming means forms a black image.

17. An image forming apparatus comprising:

a plurality of image forming means substantially vertically arranged, each of said plurality of image forming means including an image bearing member on which a latent image is to be formed and developing means for developing the latent image;

image bearing member driving means for driving said image bearing members;

development driving means for driving said developing means;

transfer material bearing and conveying means for bearing and conveying a transfer material, wherein, while the transfer material is substantially vertically conveyed through transfer nips that are formed by said transfer material bearing and conveying means and said image bearing members of said plurality of image forming means, images formed by said plurality of image forming means are sequentially transferred to the transfer material;

control means for selecting image forming means that is used for forming an image among said plurality of image forming means and for controlling said image bearing member driving means and said development driving means so that, during an image forming process, an image bearing member of image forming means that is not used for forming the image is driven and developing means of said image forming means that is not used for forming the image is halted; and a plurality of transfer means, disposed at positions opposite to each of said image bearing members with said transfer material bearing and conveying means therebetween, for transferring images on said image bearing members to the transfer material, wherein, during the image forming process, a voltage different from a voltage applied during a transfer process of the image forming process is applied to the transfer means that corresponds to image forming means that is not used for forming the image.

18. An image forming apparatus according to claim 17, wherein the different voltage has a polarity opposite to a polarity of the voltage applied during the transfer process of the image forming process.

* * * * *